United States Patent [19]

Stengard

[11] 4,159,634

[45] Jul. 3, 1979

[54] TOGGLE MECHANISM FOR PINCHING METAL TUBES

[75] Inventor: Edwin O. Stengard, College Park, Md.

[73] Assignee: The United States of America as represented by the Administrator of the National Aeronautics and Space Administration, Washington, D.C.

[21] Appl. No.: 909,100

[22] Filed: May 19, 1978

[51] Int. Cl.[2] ..... B21J 7/00; F16L 15/10

[52] U.S. Cl. ..... 72/436; 72/451; 72/470; 251/7

[58] Field of Search ..... 72/436, 451, 367, 410, 72/412, 470, 416; 251/7

[56] References Cited

U.S. PATENT DOCUMENTS

| | | | |
|---|---|---|---|
| 1,871,321 | 8/1932 | Hayford | 72/451 |
| 3,117,615 | 1/1964 | Graven | 72/416 |
| 3,260,098 | 7/1966 | Gill | 72/470 |
| 3,329,002 | 7/1967 | Schwalm | 72/426 |
| 3,730,478 | 5/1973 | Burke | 72/470 |
| 3,759,483 | 9/1973 | Baxter | 251/7 |
| 3,905,219 | 9/1975 | Niederer | 72/453.01 |
| 3,926,033 | 12/1975 | Forichon | 72/451 |
| 4,044,989 | 8/1977 | Basel | 251/7 |

*Primary Examiner*—C. W. Lanham
*Assistant Examiner*—Gene P. Crosby
*Attorney, Agent, or Firm*—Robert D. Marchant; John R. Manning; John O. Tresansky

[57] ABSTRACT

A toggle mechanism pinches a metal tube and maintains the tube in a pinched condition, without fracturing. The toggle mechanism includes a plunger translatable along a longitudinal axis, as well as a pair of links pivoted about a common axis extending through an end of the plunger. One of the links also pivots about a fixed axis. A free end of the other link carries a push link which the other link translates at right angles to the plunger longitudinal axis. First and second sides of the tube bear against a first stop block and are engaged by the push link when a compresson spring, attached to the plunger, is suddenly released to irreversibly drive the plunger along its longitudinal axis so the pivot point of the two links is driven to an over travel position. At over travel, the free end of the push link and the stop block abut against opposite sides of the tube to pinch them together. A second stop block limits the plunger motion so that there is only slight over travel of the links and the push link remains abutted against the tube to continue to pinch the tube.

8 Claims, 6 Drawing Figures

TOGGLE MECHANISM FOR PINCHING METAL TUBES

ORIGIN OF THE INVENTION

The invention described herein was made by an employee of the United States Government and may be manufactured and used by or for the Government for governmental purposes without the payment of any royalties thereon or therefor.

BRIEF SUMMARY OF THE INVENTION

The present invention relates generally to an apparatus for pinching a metal tube, and more particularly, to a pinching apparatus that is suddenly and irreversibly driven by a stored, potential energy source.

For certain applications, it is necessary to pinch a relatively small diameter metal tube and maintain the tube in a pinched condition without fracturing the tube. For example, in certain situations it is necessary to supply gas to a measuring instrument, such as a spectrometer. In one particular application, it is desired to monitor very high temperatures, such as about 900° F. and pressure gases, such as about 100 atmospheres, at different altitudes as a space probe descends to the planet Venus. Previously, a device was developed wherein a ceramic breakoff tube enables gases to flow into a stainless steel tube which leads to an analyzing spectrometer. The ceramic breakoff tube had the disadvantage of not being sealable after the monitored gases were admitted to the spectrometer. It is important to maintain the tube in a sealed condition after the gases are admitted to the spectrometer, because gases from different altitudes, if comingled, cause the spectrometer reading to be inaccurate.

Several different devices have been tried to seal the metal tube leading to the spectrometer. Amongst these are conical and ball valves, as well as an explosive driven wedge. The conical valve was not employed because it was found that the absence of a straight-through flow of such a valve impedes the flow of gas to the spectrometer, resulting in possible inaccuracies in the spectrometer reading. Another disadvantage of the conical valve is that the valve seat is necessarily made of hard, high temperature materials, which are difficult to manufacture precisely enough to enable the valve to be leak tight. Of course, if the valve is not leak tight, gases from different elevations leak into the spectrometer, resulting in inaccuracies of the spectrometer reading. The ball valve also requires great manufacturing precision and does not have a straight-through open flow path. An explosive to drive a wedge into metal, stainless steel, tubing frequently does not result in reliable closure of the tube leading to the spectrometer. In many instances, the closure is not reliable because the wedge breaks the tube in response to the explosive exerting excessive force against the wedge and, in turn, against the tube. Alternatively, the explosive does not produce enough force to pinch opposite sides of the tube against each other and provide a cold weld to seal the tube.

In accordance with the present invention, an improved apparatus for pinching a metal tube and for maintaining the tube in a pinched condition without fracturing comprises a toggle mechanism including a plunger translatable along a longitudinal axis, and a pair of links which multiply by many times the force of the plunger; the links have a common axis at an end of the plunger. One of the links has an end remote from the plunger pivoted about a fixed axis that extends at right angles to the longitudinal axis of the plunger and which is parallel to the common pivot axis of the two links. The second link includes a free end, remote from the plunger; the free end translates along a line at right angles to the plunger longitudinal axis and the common axis of the two links. A push link extends from the free end of the second link toward one side of the tube. The toggle mechanism has an initial position whereby the common axis is at a first position on one side of an aligned position for longitudinal axes of the two links and a free end of the push link is proximate one side of the tube.

A stored, potential energy source, preferably in the form of a compressed coil spring, suddenly and irreversibly drives the plunger along its longitudinal axis so the common axis for the two links is at a second position slightly on the other side of the aligned position for the longitudinal axes of the links, i.e., so there is a slight over travel of the toggle mechanism. During the driving of the links from the first position to the second position, the links exert a pressure on the push link approximately 800 times greater than the pressure exerted by the potential energy source on the links. At the second position of the toggle mechanism, the free end of the push link abuts against one side of the tube and because of the great pressure exerted by the links, pushes that side of the tube against the side of the tube in contact with a first stop block, to pinch the two sides of the tube against each other.

The longitudinal translation of the plunger is limited, preferably by a second stop block beneath the plunger, whereby only slight over travel of the toggle mechanism can occur and the free end of the push link remains abutted against the tube to continue to pinch the sides of the tube against each other. Because of the over travel of the toggle mechanism, the free end of the push link maintains the tube in a pinched state. An added advantage is that the expanded compression spring exerts a force against the plunger and the links to help maintain the free end of the push link against the tube in the event there is a substantial force applied to the mechanism tending to reverse the direction of the plunger away from the second stop block against which it is urged.

Because it is important to limit the over travel of the plunger and links to assure that the tube remains pinched by the free end of the push link, the extent of over travel of the plunger and push links must be variable to effectively control the final position of the common, pivot axis for the two links. In a preferred embodiment, the over travel is effectively varied by adjusting the separation of the second stop block relative to the longitudinal axis of the plunger.

It is, accordingly, an object of the present invention to provide a new and improved apparatus for pinching a metal tube and for maintaining the tube in a pinched condition without fracturing the tube.

Another object of the invention is to provide an apparatus for pinching a straight metal tube to a closed position which is maintained.

Another object of the invention is to provide a new and improved apparatus, utilizing relatively inexpensive, low tolerance parts, that can pinch a tube closed and maintain it in a closed condition so that very high temperature and pressure gases cannot flow through the pinched tube.

A further object of the invention is to provide a new and improved, single shot mechanism for pinching a metal tube and for maintaining the tube in a pinched condition without fracturing the tube.

A still further object of the invention is to provide a new and improved toggle mechanism that multiplies a force exerted thereon approximately 800 times for pinching a metal tube and for maintaining the tube in a pinched condition without fracturing the tube.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWING

In the drawings where like parts are designated by the same references.

DESCRIPTION OF THE PREFERRED EMBODIMENT

Figure 1:
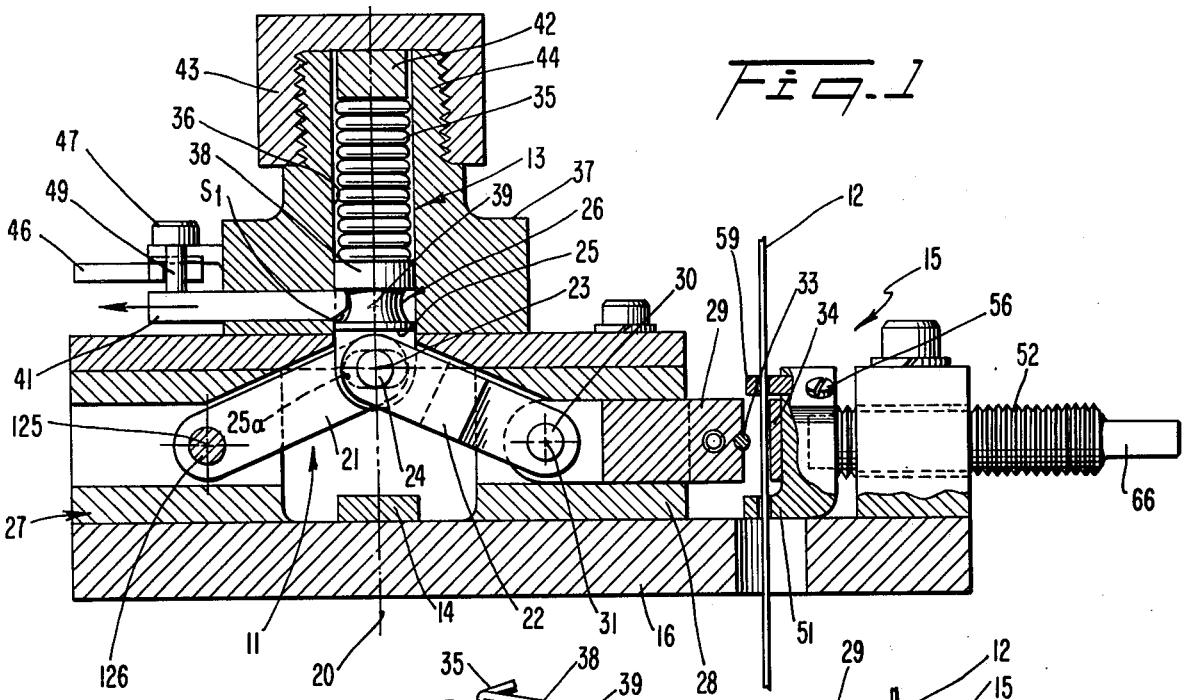
FIGS. 1 and 1*a* are side sectional views showing the pinched position of the tube.
Figure 2:
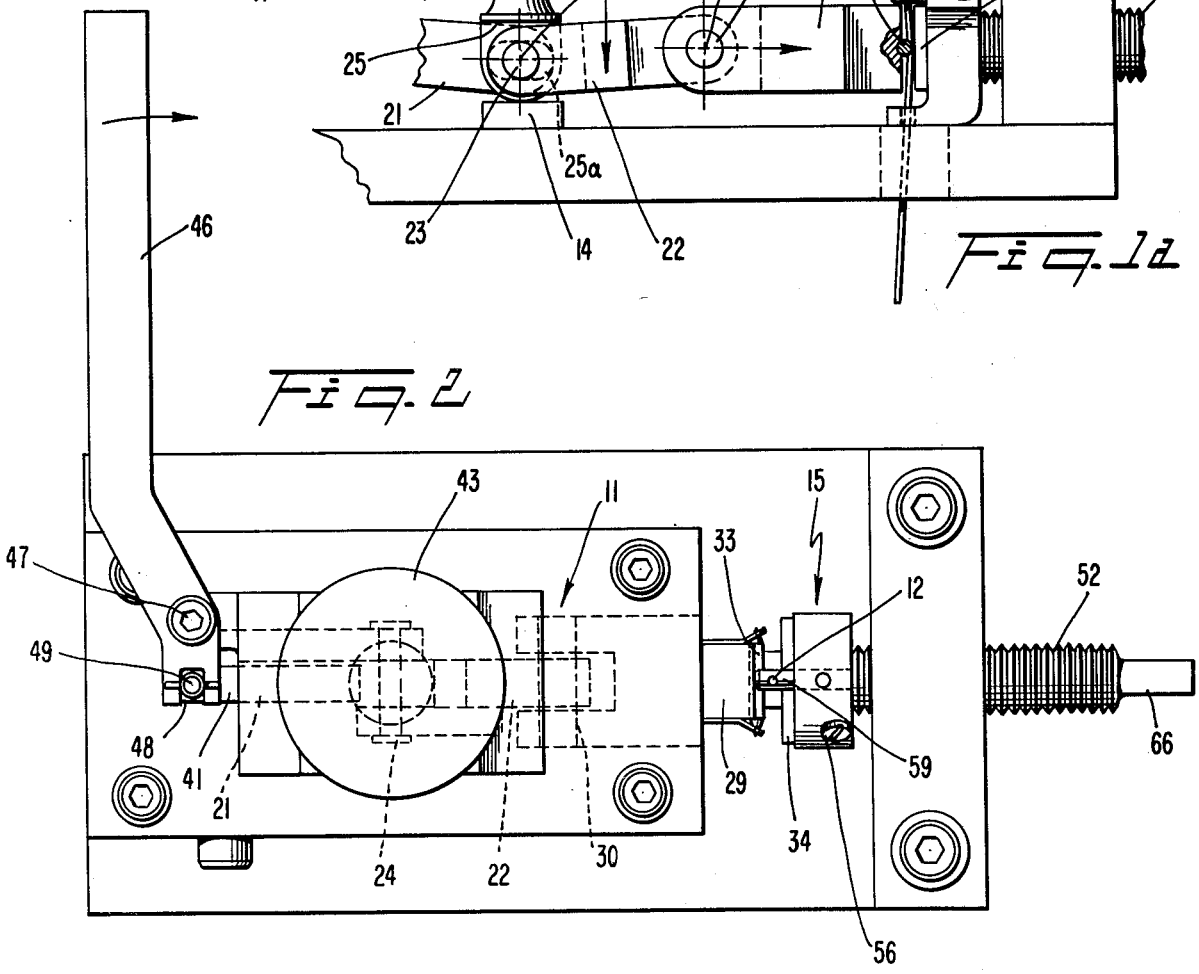
FIG. 2 is a top view of the apparatus illustrated in FIG. 1.

Reference is now made to FIGS. 1 and 2 of the drawing wherein there is illustrated an irreversibly driven, one shot toggle mechanism 11 for pinching relatively small diameter stainless steel tube 12. Toggle mechanism 11 pinches tube 12, without fracturing the tube, and maintains the tube in a pinched condition. In one application, tube 12 has inner and outer diameters on the order of 0.050 inches and 0.070 inches, respectively, and is used as a conduit for enabling relatively high temperatures, such as about 900° F., and pressure gases, such as about 100 atmospheres, to flow to a gas analyzing instrument, such as a spectrometer (not shown), on a space probe descending through the atmosphere of Venus. Toggle mechanism 11 is driven suddenly and uni-directionally by a stored, potential energy source 13 to a slight over travel position. Toggle mechanism 11 exerts a force of approximately 800 times greater than the force applied to the toggle mechanism by potential energy source 13. The extent of over travel is determined by the height of stop block 14, located beneath drive source 13, and the separation of a second stop block 15 from longitudinal axis 20 of drive 13. Stop block 15 bears against a side of tube 12 opposite from toggle mechanism 11. The position of block 15 is variable, to control the extent of over travel of toggle mechanism 11.

Toggle mechanism 11, drive 13, and stop block 14 are fixedly mounted on base 16, which also carries stop block 15 that is translatable on the surface of the base. Toggle mechanism 11 includes inner and outer links 21 and 22, having first ends that pivot about axis 23 that extends through pin 24, which joins the first ends of the links together and to boss 25 of plunger 26. Boss 25 includes an elongated slot 25*a* through which pin 24 extends to allow slight movement of the first ends of links 21 and 22. Longitudinal axis 20, that defines the longitudinal axis of drive 13 and extends through axis 23, also is the longitudinal axis of plunger 26. The other end of link 21 is pivotable about fixed axis 125, defined by the center of pin 126, which is fixedly mounted on base 16 by housing 27. The other end of link 22 is free to translate on abutment 28 that extends from base 16. The free end of link 22 is connected to push link 29 by pin 30, having an axis 31 that is at the same height above the surface of base 16 as axis 125. Pin 30 rotates about axis 31 so that push link 29 is translated in a direction perpendicular to both plunger axis 20 and the parallel axes 23, 125 and 31 of pins 24, 126 and 30, respectively. The translation of push link 29, perpendicular to axis 20 and parallel to axes 23, 125 and 31, is the action which greatly multiplies the force exerted by drive 13. Rotatably mounted on push link 29 is a roller 33, having a center of rotation that is aligned with axes 125 and 31, and which is adapted to bear against the side of tube 12 opposite from the side of the tube that bears against anvil 34 that is mounted on stop block 15. The center of anvil 34 is aligned with axes 125 and 31. It should be noted that although anvil 34 is shown as a separate component of stop block 15, it may be made an integral part thereof.

Figure 1A:
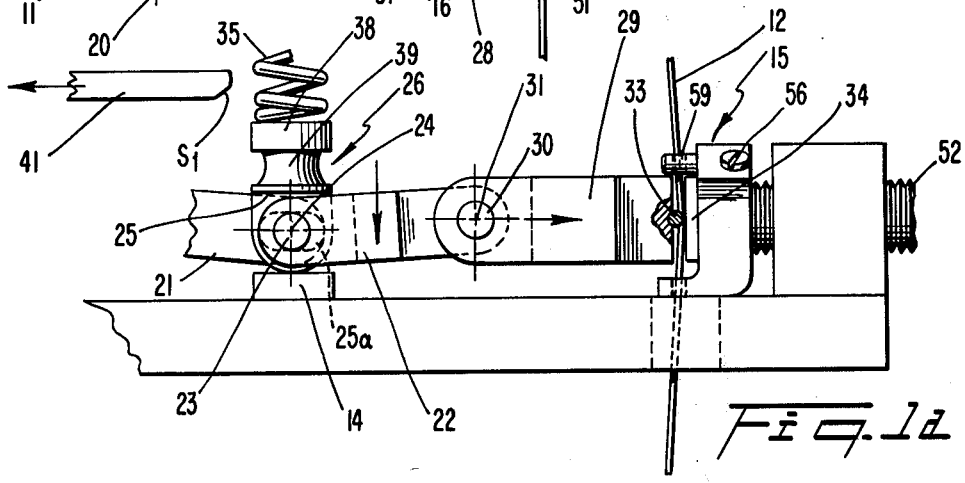

Toggle mechanism 11 is initially positioned so that axis 23 is sufficiently above the upper surface of stop block 14 to prevent alignment of the longitudinal axis of links 21 and 22, i.e., the longitudinal axes of the links are on one side of an aligned position therefor. Drive mechanism 13 suddenly and irreversibly drives links 21 and 22 to a slight over travel position, so that the longitudinal axes of the links are on the other side of an aligned condition for these axes, as illustrated in FIG. 1*a*.

The sudden and irreversible drive mechanism 13 includes a compression spring 35 that is positioned, in an initial, coiled state, in bore 36 of housing 37 that is fixedly mounted to base 16 by housing 27. Spring 35 has a lower end that bears against the upper face of flange 38 that is a part of plunger 26. Sandwiched between the lower face of flange 38 and the upper face of boss 25 is race 39 into which detent pin 41 extends, to hold spring 35, and the remainder of toggle mechanism 13, in the illustrated, initial position. The upper end of spring 35 is compressed by plug 42, which fits into bore 36 and is held in situ by the interior, flat face of threaded spring cap 43 which engages threaded sleeve 44 that extends from spring housing 37.

Detent pin 41 is driven by a suitable actuator (not shown) to enable spring 35 to expand and drive boss 25 and links 21 and 22 downwardly, against the upper face of stop block 14. To this end, there is a pivotable connection between detent pin 41 and arm 46 that is secured to housing 37 by pin 47, about which the arm pivots. An end of arm 46, aligned with the axis of pin 47, includes slot 48 into which pin 49 extends. Pin 49 extends radially from and is fixedly positioned on detent 41. In response to the end of arm 46 being driven by the actuator toward axis 20, the arm pivots about pin 47, causing rotation of detent pin 41 about pin 49 and release of the holding force by the upper face of detent pin 41 against the lower face of flange 38. The stored, potential energy of spring 35 thereby drives plunger 26 and links 21 and 22 downwardly. Because of the speed that spring 35 drives plunger 26 downwardly, it is necessary to provide the end of detent pin 41 with a bevel $S_1$; otherwise, there is a possibility of the detent pin being hung up by the upper face of boss 25.

In response to drive mechanism 13 driving toggle mechanism 11 from the illustrated, initial position to the slight over travel position, push link 29 drives roller 33 with a force that is some 800 times greater than the downward force exerted by spring 35 against a first side of tube 12 while the other side of tube 12 bears against anvil 34. Roller 33 drives the first side of tube 12 against the other side of the tube with this great force, to pinch the tube to a closed condition and prevent gases, such as high pressure and high temperature gases of 100 atmospheres and 900° F., as exist in the atmosphere of Venus, from flowing through tube 12. Because of the slight over travel of links 21 and 22, roller 33 continues to pinch the forced side of tube 12 in the pinched condition. If, however, there should be some external force tending to restore links 21 and 22 to the initial condition, such as impact on the surface of Venus, this external force is further resisted due to the force exerted by spring 35 on flange 38.

Figure 3:
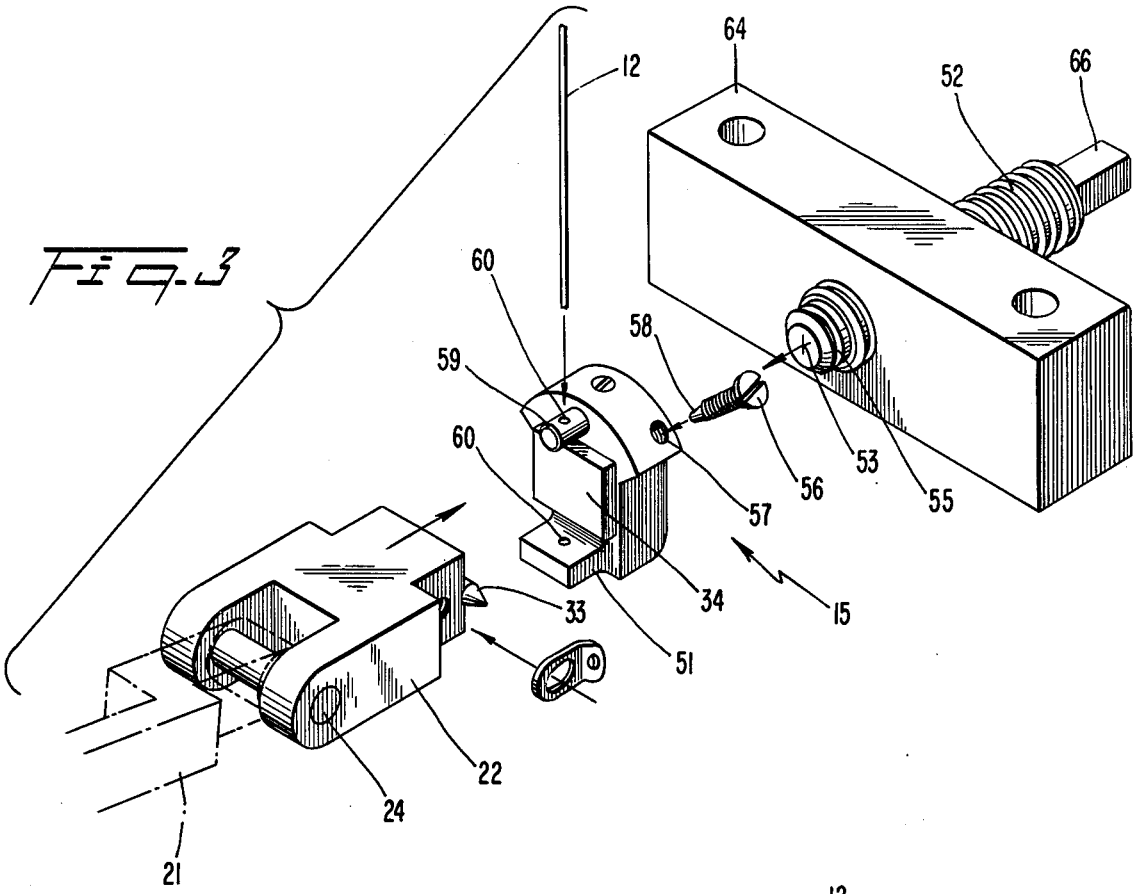
FIG. 3 is an exploded, perspective view of a mechanism for adjusting the position of a stop block and guide for the tubing.
Figure 4:
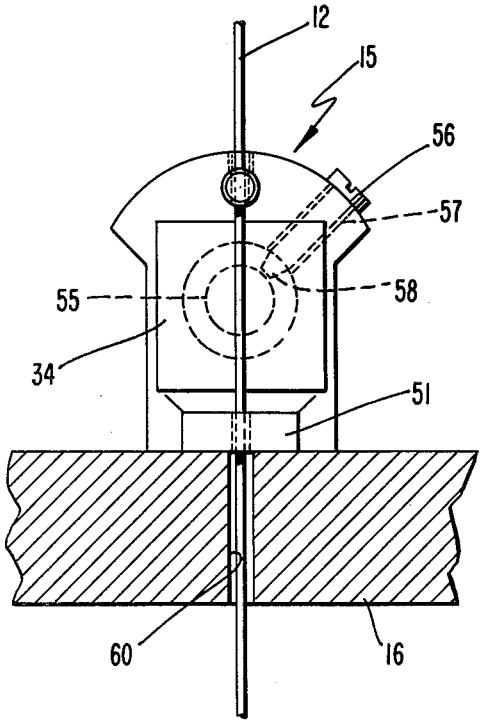
FIGS. 4 and 5 are front and side sectional views of the mechanism illustrated in FIG. 3.
Figure 5:
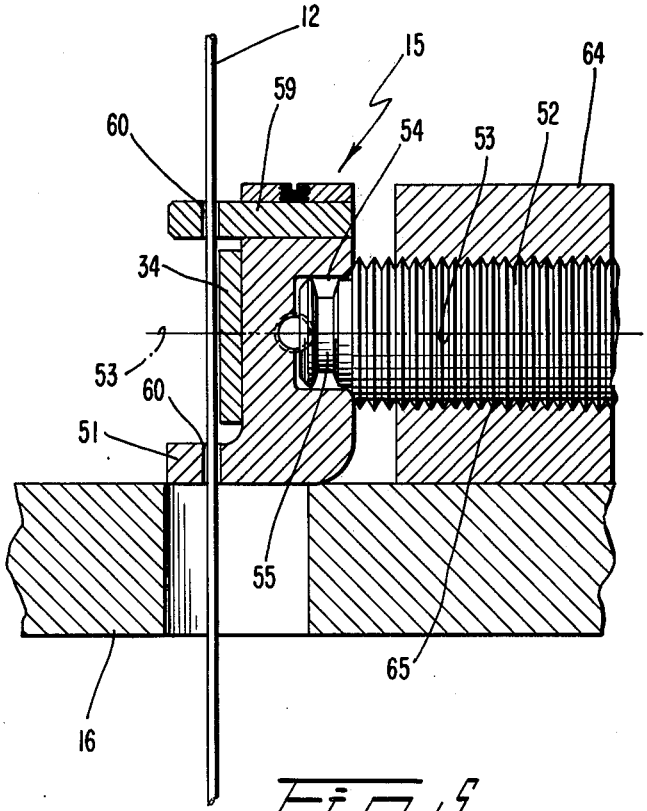

To control the extent of over travel of toggle mechanism 11, the spacing between stop block 15 and axis 20 is accurately controlled by the mechanism illustrated in FIGS. 3, 4 and 5. Stop block 15 includes a foot 51 that slides along base 16 and which enables the stop block to be driven to a variable position relative to axis 20, in response to rotation of threaded cylinder 52 about its longitudinal axis 53. Stop block 15 includes a bore 54, coaxial with axis 53, into which groove 55 of cylinder 52 fits. Groove 55 is held in situ in bore 54 by screw 56 extending radially through bore 57 of the stop block. Screw 56 includes a tapered end 58 that engages groove 55; screw 56 is maintained in situ in bore 57 by the screw and bore having complementary threads.

Tube 12 is guided relative to stop block 15 by virtue of the stop block including a fixedly mounted stud 59, having a bore 60 at one end thereof. Bore 60 has a diameter to accommodate the outer diameter of tube 12, so that the tube fits somewhat snugly within the bore. The right side of bore 60 and anvil 34 (as illustrated in FIG. 3) define a plane along which one side of tube 12 extends. Anvil 34 is connected to block 15, such as by welding or may be made integral with block 15 if desired.

The position of cylinder 52 is maintained by block 64 that is fixedly mounted on base 16 and which includes a threaded bore 65 that engages the threads of cylinder 52. Cylinder 52 includes a square end 66 which is rotatably driven by a suitable tool, whereby turning of shaft 52 results in translation of block 15 and guide 59, as well as roller 34 relative to axis 20.

In response to detent 41 releasing flange 38, spring 35 drives links 21 and 22 against stop block 14, causing roller 33 to pinch tube 12 against anvil 34, the position of which is controlled as described supra.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. Apparatus for pinching a metal tube and for maintaining the tube in a pinched condition without fracturing the tube comprising a stop block against which a first side of the tube bears, a toggle mechanism including: a plunger translatable along a longitudinal axis, a first link having a longitudinal axis and first and second ends respectively pivoted about a fixed first axis at right angles to the longitudinal axis of the plunger and a second axis through the plunger, the first and second axes being parallel to each other, a second link having a longitudinal axis and a first end pivoted about the second axis and a second end free to translate along a line at right angles to the longitudinal axis of the plunger and the second axis, a push link extending from the free end of the second link toward a second side of the tube opposite from the first side, said toggle mechanism having an initial position so the second axis is at first position on one side of an aligned position for the longitudinal axes of the first and second links and a free end of the push link is proximate the second side of the tube; a stored, potential energy source for suddenly and irreversibly driving the plunger along its longitudinal axis so the second axis is at a second position slightly on the other side of the aligned position for the longitudinal axes of the links and the free end of the push link abuts against the second side of the tube to pinch the second side of the tube against the first side of the tube; and means for limiting the longitudinal translation of the plunger so the second axis remains at the second position and the free end of the push link remains abutted against the second side of the tube to continue to pinch the second side of the tube against the first side of the tube.

2. The apparatus of claim 1 wherein the energy source comprises: a compression spring having a tendency to urge the plunger along its longitudinal axis, means for maintaining the spring in a compressed state while the second axis is at the first position and for enabling the spring to suddenly expand to drive the plunger so the second axis is at the second position.

3. The apparatus of claim 2 wherein the means for maintaining includes a flange having a first face against which one end of the spring is urged, said flange having a second face extending from a race into which an end of a detent pin extends, said end of the detent pin having a first surface against which the second face of the flange bears and a beveled face opposite from the first surface.

4. The apparatus of claim 1 further including means for varying the second position of the second axis.

5. The apparatus of claim 4 wherein the means for varying includes means for adjusting the separation of the stop block relative to the longitudinal axis of the plunger.

6. The apparatus of claim 1 wherein the stop block carries a guide for the tube to maintain the tube in situ while the energy source is driving the plunger and the tube is being pinched.

7. The apparatus of claim 1 wherein the free end of the push link exerts a pressure on the second side of the tube substantially greater than the pressure exerted by the potential energy source.

8. The apparatus of claim 7 wherein the pressure exerted on the second side of the tube is substantially 800 times greater than the pressure exerted by the potential energy source.

* * * * *